United States Patent [19]

Mas et al.

[11] 4,213,256

[45] Jul. 22, 1980

[54] SNOW SHOE

[76] Inventors: Henri Mas, 14 Quai Antoine ler; Paul Lacroix, 8 bd du Jardin Exotique, both of, Monaco

[21] Appl. No.: 925,686

[22] Filed: Jul. 18, 1978

[30] Foreign Application Priority Data

Jul. 18, 1977 [FR] France ..... 77 22995
Jun. 20, 1978 [FR] France ..... 78 19400

[51] Int. Cl.[2] ..... A43B 5/04
[52] U.S. Cl. ..... 36/124
[58] Field of Search ..... 36/122, 123, 124, 125

[56] References Cited

U.S. PATENT DOCUMENTS 2,511,087 6/1950 Villemur ..... 36/124
2,769,250 11/1956 Rinkinen ..... 36/124
3,596,374 8/1971 Covington ..... 36/125
4,045,889 9/1977 Woolworth ..... 36/122

*Primary Examiner*—Patrick D. Lawson
*Attorney, Agent, or Firm*—Young & Thompson

[57] ABSTRACT

A snow shoe, useful also in sand, comprises a flat member which is bisymmetric in the sense that its upper and lower sides are mirror images of each other. A pair of such snow shoes thus comprises two identical members disposed in mirror image relationship. The portion that supports the foot is displaced toward the inner side of the snow shoe, and the laterally outer portion comprises an open gridwork supported by a frame, the whole being of molded plastic construction. The portion that supports the foot is provided with holes therethrough adjacent the margins of the foot or shoe of the user; and a single lace can be inserted through these holes to provide front and rear bindings for the foot or shoe.

11 Claims, 8 Drawing Figures

SNOW SHOE

The present invention relates to a snow shoe useful on snow or sand.

Snow shoes as known heretofore are generally made of wood and are of very ancient design. Thus, certain known snow shoes are quite long, rounded at the front and pointed at the rear. Such snow shoes are used for example in Canada. Recent designs of snow shoes are round or oval. About the periphery of a frame, which is usually wood, and provided an enclosure, are disposed cords or straps on which the foot and/or shoe of the user rests. There is a shoe for the right foot and a shoe for the left foot.

These shoes require the user to hole his feet in spaced relation when walking. In fact, by virtue of their shape, in order to avoid knocking the legs while walking, it is necessary to walk with the legs held apart. Moreover, in powdery snow, these shoes clog very rapidly, which is to say that snow clings to the shoes. The user thus raises a considerable weight of snow under each shoe at each step. On the other hand, on hard or glazed snow, only the frame of the shoe is in contact with the snow. As a result, on an incline, the shoe has an adherence and the user may thus slide with each step. Known snow shoes have a symmetrical form and the foot or shoe is disposed generally in the center of the snow shoe.

Finally, the construction of the known snow shoes is archaic; and a considerable effort is therefore required to string the frames.

It is an object of the present invention to overcome all of the above disadvantages.

Another object of the present invention is to permit the user to walk normally without lifting his feet higher than in normal walking and without spacing his feet farther apart than in normal walking.

According to the present invention, a snow shoe is provided which is bisymmetric and which may be used, merely by inverting it, either for the left foot or for the right foot, and which may be rapidly put on no matter what the foot size of the user. The snow shoe according to the present invention can be produced industrially of plastic material; and as the two shoes of a pair are identical, only a single mold is needed.

The user may walk normally with snow shoes according to the present invention, which is to say while moving his feet to the front or to the left or right. Thanks to the bisymmetry of the shoe, the user need not fear knocking the shoes against each other when walking and so may walk without abnormally spacing his legs. Finally, thanks to the relatively small thickness of the snow shoe of the present invention, and its crosssectional configuration and the way in which its strips contact the snow, the snow shoe according to the present invention adheres completely to glazed snow, so that the user does not slip. Thanks to their lacing arrangement, the user may quickly don them without fear of their becoming lost or loosened.

The snow shoe according to the present invention is comprised of two main parts: a plain shoe part on which rests the foot or shoe of the wearer to be fixed to the same, and a perforated or reticulated part, disposed between the plain part and a bordering frame. The plain part is disposed against the inner edge of the snow shoe; while the perforated part is disposed against the outer edge of the snow shoe which serves as the frame. Holes are provided through the plain part, on each side of the region on which rests the edges of the foot or shoe of the user. A lace passing through these holes forms front and rear bindings or stirrups for fixing the foot or shoe of the user to the snow shoe of the present invention.

According to another embodiment of the snow shoe according to the present invention, the longitudinal axis of the shoe part of the snow shoe is inclined at a small angle at the level of the toes relative to the inner edge of the snow shoe while the longitudinal axis of the plain part at the level of the heel is either near or against the inner edge of the snow shoe. In other words, the longitudinal axis of the foot of the wearer is inclined forwardly outwardly at a small acute angle relative to the longitudinal axis of the snow shoe as a whole. Also, about the periphery of that portion of the plain surface on which the foot or shoe of the wearer rests, there may be provided ribs which project upwardly and downwardly and serve to grip the snow on the underside and the foot or shoe of the user on the upper side.

Also, projections may be provided on the periphery of the snow shoe.

The foot-supporting portion may also have grooves for gripping the sole of the wearer's shoe and a rear abutment for his heel. Again, on the underside, these same parts improve the adhesion to the snow.

Other objects, features and advantages of the present invention will become apparent from a consideration of the following description, taken in connection with the accompanying drawings, in which.

Figure 1:
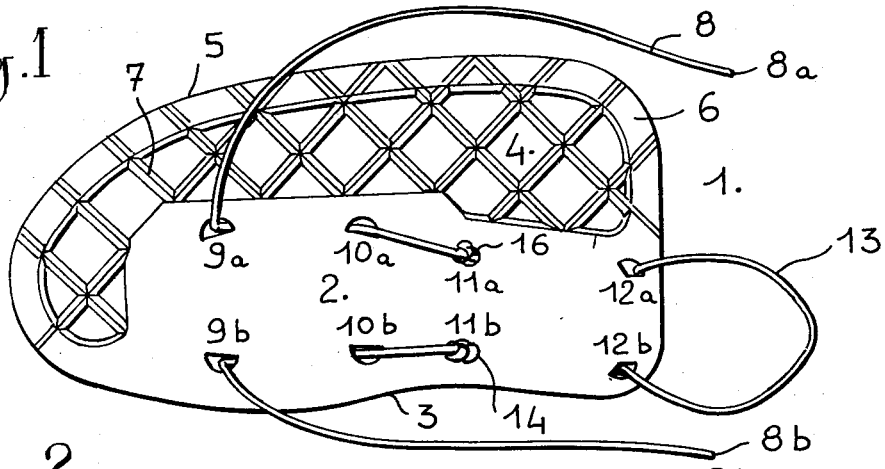
FIG. 1 is a top plan view of a snow shoe according to the present invention.

Referring now to the drawings in greater detail, and first to the embodiment of FIGS. 1–4, there is shown a snow shoe 1 which is bisymmetric in the sense that its upper and lower surfaces are mirror images of each other, comprised by a plain shoe portion 2 disposed near the inner edge 3 of snow shoe 1. A perforated portion 4 is disposed against the outer edge 5 of snow shoe 1, between a frame 6 and the plain shoe portion 2. Perforated portion 4 is formed by a square grid 7 whose diagonals are either parallel or perpendicular to the longitudinal axis of snow shoe 1. The edges of grid 7 are diamond—shaped as shown in cross section in FIG. 4, having upper and lower edges **7*a* and 7*b* which increase the adherence even to hard snow. The same is true for the frame 6 with its edges 6*a* and 6*b***.

A lace 8 passes through holes **9*a*, 10*a*, 11*a* and 12*a* along one side of plain portion 2 and through holes 9*b*, 10*b*, 11*b* and 12*b* on the other side of plain portion 2. Lace 8 may for example pass, as shown in FIG. 1, along the following course: the end 8*a* enters through 9*b*, leaves through 10*b*, enters through 11*b*, leaves through 12*b* so as to form a rear stirrup 13, then enters through 12*a*, leaves through 11*a*, enters through 10*a* and then leaves from 9a; the other end 8b thus leaves through hole 9b**.

The snow shoe being ready to be put on, there is first of all a trial to see if the size of the rear binding 13 is right. Once this is done, the lace is held in position and knots 14 and 16 are tied which prevent lace 8 from passing back through the holes. This adjustment need be performed only once, and then the user can lace his foot or shoe on the plain portion 2 and, holding the ends 8a and 8b of the lace, can cross these ends above shoe 6 to form a forward stirrup or binding 17 and then lace them through the rear binding 13 after which the ends are tied in the usual bow knot or the like. The shoe C is thus securely bound to the snow shoe 1.

It will be recognized that the simplicity of this mode of attachment is very desirable. The binding cannot come loose and permits various users of different shoe sizes to use a same pair of snow shoes.

Figure 2:
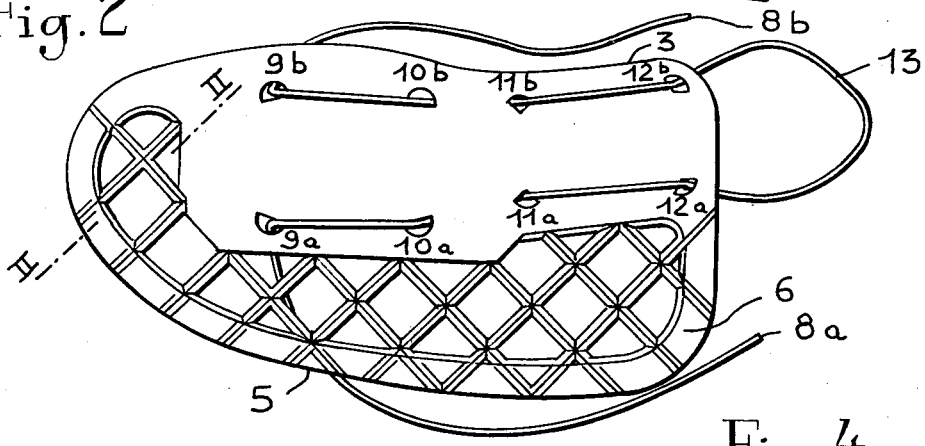
FIG. 2 is a bottom plan view of the same.
Figure 4:
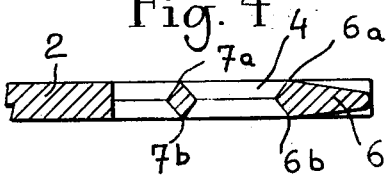
FIG. 4 is a fragmentary cross-sectional view taken on the line II—II of FIG. 2.
Figure 3:
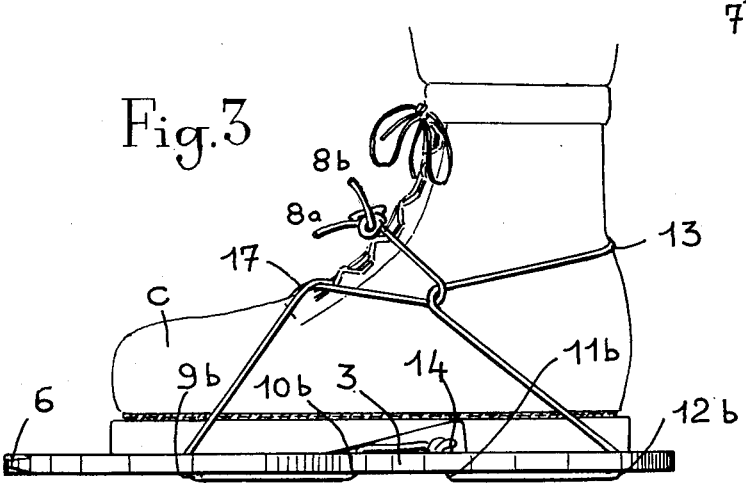
FIG. 3 is a side elevational view showing the relationship of the snow shoe of the present invention to the foot of a wearer.

In FIG. 2, which shows what might be called the sole of the snow shoe for the right foot, it will be seen that the lace 8 is in contact with the ground between the pairs of holes 9b and 10b, 9a and 10a, 11b and 12b, and 11a and 12a, which contact actually improves the adherence of the snow shoe to the snow, especially when the shoe rests on glazed snow.

Of course other modes of securement may be provided, but the mode of securement illustrated is efficacious, because the foot or shoe of the wearer is held securely to the snow shoe and it is quick and easy to put on the snow shoe.

Also, as to the perforated portion, it is possible to provide other forms of strips; but the strips in the geometric form according to the present invention with their sharp edges, permit industrial fabrication of the snow shoe at the same time that good adherence to the substrate is achieved.

Turning now to the alternative constructions shown in FIGS. 5, 6, 7 and 8, it will be seen that in these other embodiments, the plain portion that supports the foot is inclined relative to the axis of the snow shoe and may even be out of contact with the inner edge thereof.

Thus, the foot axis X, which is also the longitudinal axis of the plain portion 2 of the snow shoe, is slightly inclined from the level of the toes, that is, from the forward portion thereof; while the axis X at the level of the heel 20 passes closer to the inner edge 3. Thus, the axis X makes, with the line I–J against the inner edge 3 of the snow shoe, a small acute angle $\alpha$.

Figure 6:
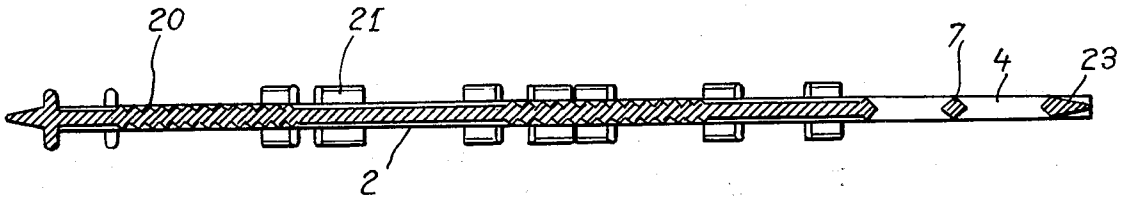
FIG. 6 is a cross-sectional view taken on the line A—A of FIG. 5.

At the level of the border 22 of the plain portion 2 of the snow shoe are disposed ribs 21 which project relative to the general thickness of the snow shoe. These ribs 21 are not all on the same axis but rather are disposed at right angles to each other. Ribs 21 project from both sides of the snow shoe, as seen in FIG. 6.

Figure 5:
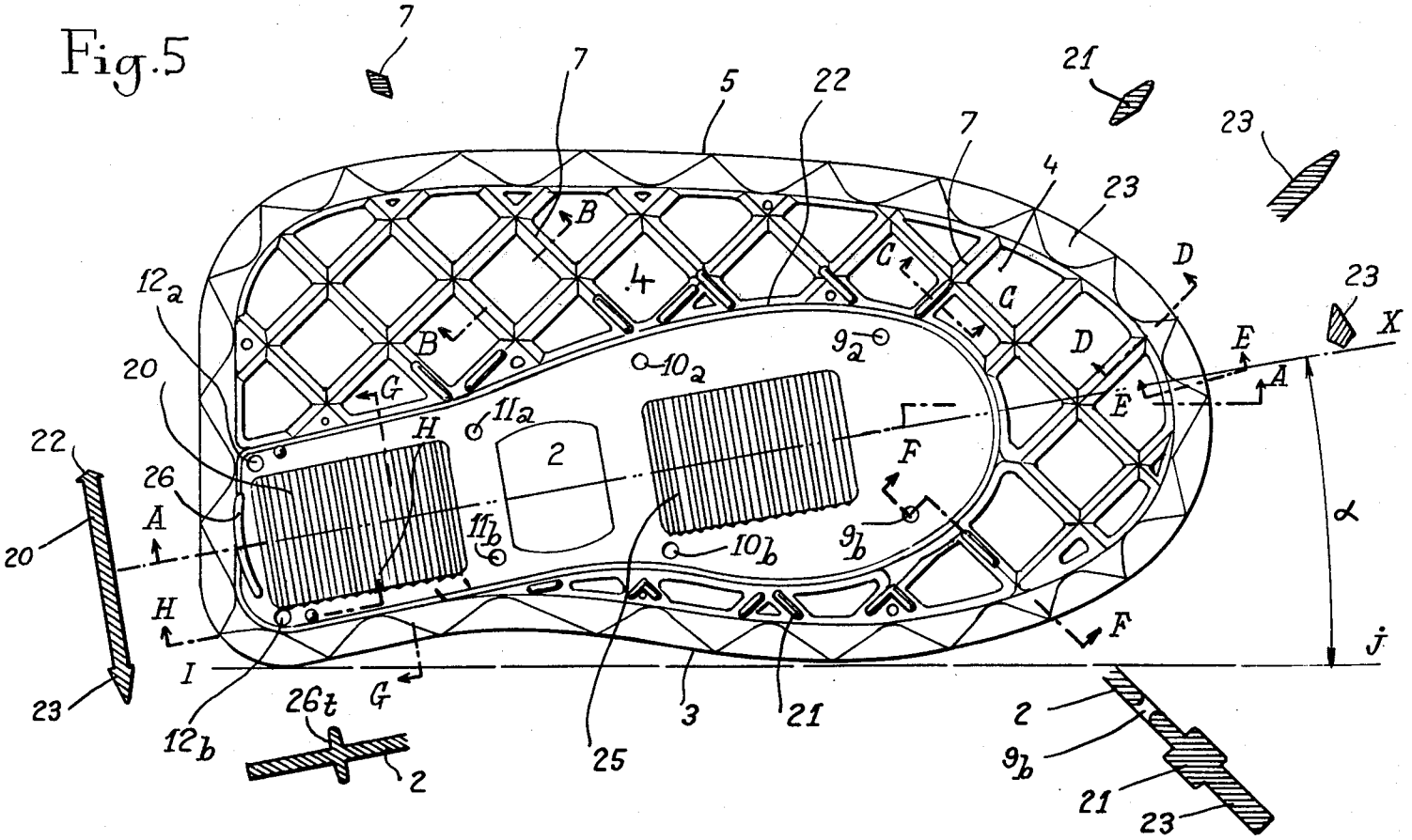
FIG. 5 is a plan view of a modified form of snow shoe according to the present invention.

As seen in the section B—B in FIG. 5, a strip 7 may have the contour there shown; or, if it is close to the periphery of the plain portion 2, may have a more ribbed contour as shown on the section line C—C.

A section on the line D—D terminates in a bevel adjacent the periphery 23 of the snow shoe, as is also shown on this portion of FIG. 5.

The section E—E shows the cross section of the snow shoe at another position along the periphery 23.

The section F—F passes through a portion of the plain portion 2, then through one of the holes 9b, through a rib 21, and finally through periphery 23.

The section G—G passes through the periphery 22 of the plain portion 2, and then through the periphery 23 of the snow shoe.

The section H—H shows one of the pegs 26t on the plain portion 2.

Figure 7:
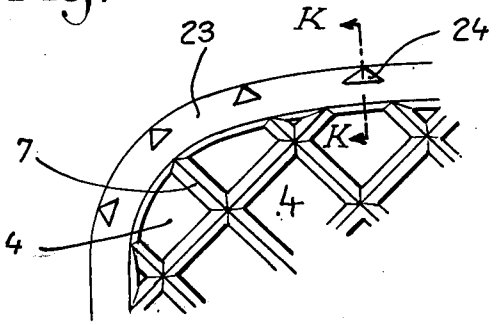
FIG. 7 is a fragmentary plan view of another form of snow shoe according to the present invention.

Section K—K, taken on FIG. 7, shows a section along periphery 23, in the case of a modified construction of snow shoe in which the periphery 23 has projections 24.

Figure 8:
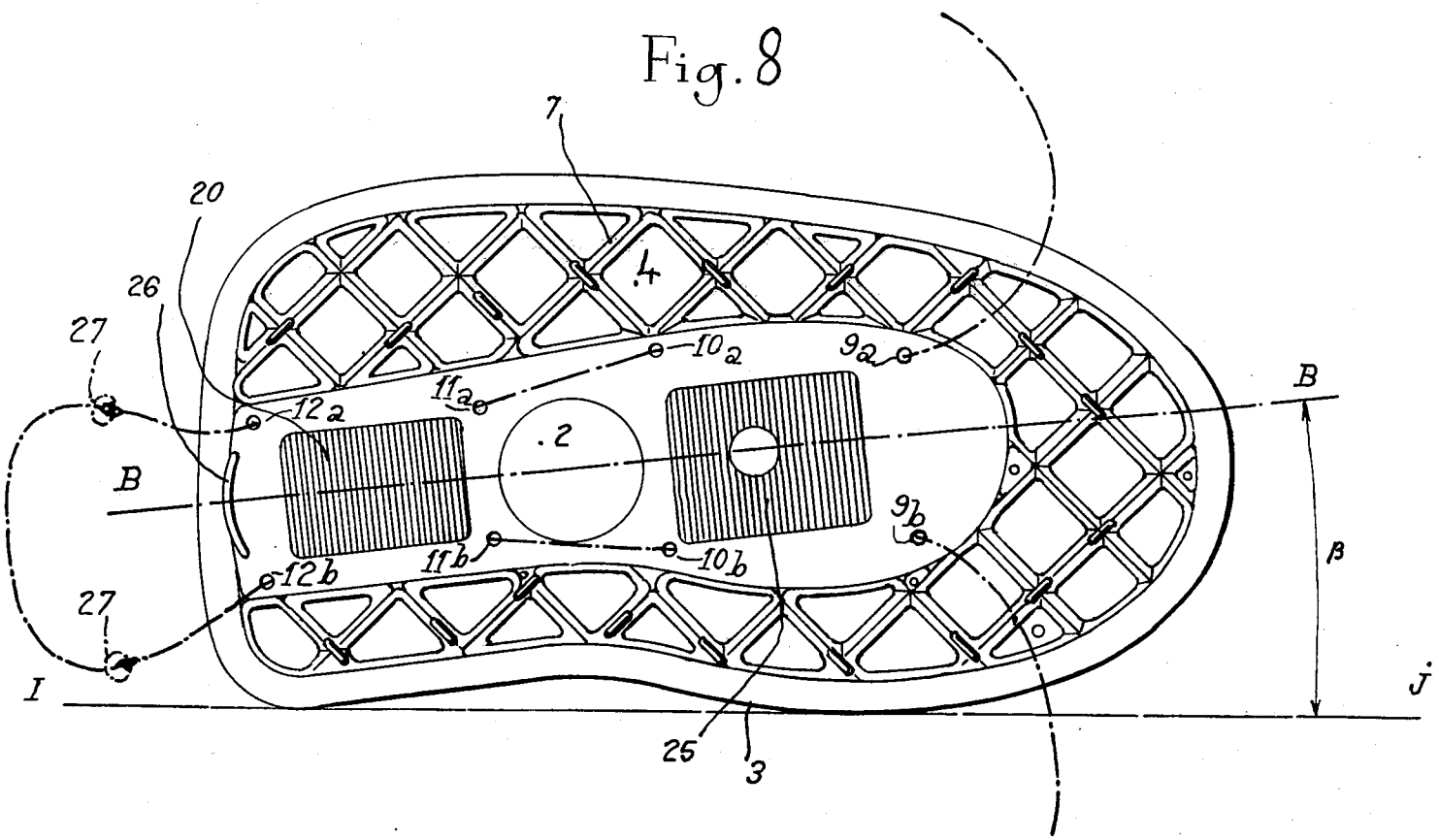
FIG. 8 is a plan view of still another form of snow shoe according to the invention.

As shown in FIGS. 5 and 8, and also to some extent in FIG. 6, the plain portion 2 has grooves 25 which improve the grip of the wearer's shoe on the snow shoe.

The snow shoe will equally be held on by the rear heel plate 26 against which the heel abuts.

As shown in FIG. 8, metal rings 27 can be provided at the junction of the front and rear bindings 17 and 13, through which the interengaged loops of the laces can slide.

The snow shoe shown in FIG. 8 is like those described above, but the plain portion 2 is spaced from the inner edge even beside its heel portion and is surrounded by gridwork except at the rear of that heel portion.

Thus, in FIG. 8, the axis B—B, which is the longitudinal axis of the plain portion 2, forms with the line I–J a small acute angle $\beta$.

Finally, according to the alternative embodiment shown in FIG. 5, the holes 11a, 11b are no longer disposed on the periphery of the plain portion 2, but are closer to the axis X, or the axis B—B in FIG. 8, so as to provide better gripping of the wearer's shoe.

Of course, the snow shoe according to the present invention is formed of molded plastic, for which any molded plastic conventional for shoe soles may be utilized.

Snow shoes according to the present invention are particularly adapted for walking on snow but are also usable on other surfaces such as sand, on which the perforated construction of the present invention is also particularly useful.

Form a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A snow shoe comprising, within a frame, a plain portion on which the foot of the wearer rests, and, between the plain portion and the frame, a perforated portion, means for securing the wearer's shoe to the snow shoe, and means on the underside of the snow shoe to grip the snow, the snow being elongated and the axis of said plain portion forming a small acute angle with the axis of the snow shoe.

2. A snow shoe as claimed in claim 1, said perforated portion surrounding the forward portion of said plain portion.

3. A snow shoe as claimed in claim 1, the heel of said plain portion being disposed against the inner edge of the snow shoe.

4. A snow shoe comprising, within a frame, a plain portion on which the foot of the wearer rests, and, between the plain portion and the frame, a perforated portion, means for securing the wearer's shoe to the snow shoe, and means on the underside of the snow shoe to grip the snow, holes in said plain portion adjacent the margins thereof, and a flexible lace passing through said holes for securing the snow shoe to the shoe of a wearer.

5. A snow shoe as claimed in claim 4, in which said holes are at least eight in number.

6. A snow shoe as claimed in claim 4, said lace forming front and rear bindings for the shoe of a wearer.

7. A snow shoe as claimed in claim 4, said lace being knotted to prevent its slipping through said holes.

8. A snow shoe as claimed in claim 4, and metal rings through which portions of said lace slide to form front and rear bindings for a shoe of a wearer.

9. A snow shoe as claimed in claim 4, in which said lace is threaded in and out through said holes to form front and rear bindings for the shoe of a wearer, said front and rear bindings being inclined with each other.

10. A snow shoe comprising, within a frame, a plain portion on which the foot of the wearer rests, and, between the plain portion and the frame, a perforated portion, means for securing the wearer's shoe to the snow shoe, and means on the underside of the snow shoe to grip the snow, said plain portion being disposed against the inner edge of the snow shoe while the perforated portion is disposed against the outer edge of the snow shoe comprised by said frame.

11. A snow shoe comprising, within a frame, a plain portion on which the foot of the wearer rests, and, between the plain portion and the frame, a perforated portion, means for securing the wearer's shoe to the snow shoe, and means on the underside of the snow shoe to grip the snow, said snow shoe being flat and bisymmetric in its own mid-plane whereby the upper and lower surfaces of the snow shoe are mirror images of each other.

* * * * *